United States Patent [19]

Henk

[11] 4,288,205

[45] Sep. 8, 1981

[54] VARIABLE VOLUME PERISTALTIC PUMP

[75] Inventor: Keith L. Henk, Brooklyn Park, Minn.

[73] Assignee: Pako Corporation, Minneapolis, Minn.

[21] Appl. No.: 113,331

[22] Filed: Jan. 18, 1980

[51] Int. Cl.[3] ..... F04B 43/12; F04B 45/08

[52] U.S. Cl. ..... 417/477

[58] Field of Search ..... 417/474–477

[56] References Cited

U.S. PATENT DOCUMENTS

| | | | |
|---|---|---|---|
| 3,583,838 | 6/1971 | Stanber | 417/477 X |
| 3,591,319 | 7/1971 | Shlisky | 417/477 |
| 3,609,069 | 9/1971 | Martinelli et al. | 417/474 |
| 3,723,030 | 3/1973 | Gelfand | 417/477 X |
| 3,737,251 | 6/1973 | Berman et al. | 417/12 |
| 3,990,444 | 11/1976 | Vial | 417/477 X |

FOREIGN PATENT DOCUMENTS

| | | | |
|---|---|---|---|
| 2812805 | 10/1978 | Fed. Rep. of Germany | 417/477 |

*Primary Examiner*—Richard E. Gluck

*Attorney, Agent, or Firm*—Kinney, Lange, Braddock, Westman and Fairbairn

[57] ABSTRACT

A peristaltic pump driven by a single speed power source has a fixed length of flexible wall tubing circumferentially positioned between the wall of the inner chamber and an adjustable band. The flexible band has one end fixed to the pump housing and the other to an adjusting screw. Turning the adjusting screw varies the effective length of the adjustable band and consequently the degree of contact with the flexible wall tubing. Increasing the effective length of the adjustable band flattens the tubing against the wall, thereby changing the volumetric capacity of the tubing and delivery rate of the pump. Decreasing the effective length of the adjustable band has the opposite effect.

16 Claims, 5 Drawing Figures

VARIABLE VOLUME PERISTALTIC PUMP

BACKGROUND OF THE INVENTION

1. Field of the Invention

The present invention relates to peristaltic pumps driven by a single speed power source and in particular to peristaltic pumps whose volumetric delivery rate is adjustable.

2. Description of the Prior Art

A peristaltic pump consists of a flexible tube within a housing having an arcuate chamber where a flexible tube is circumferentially compressed by a series of rollers or an eccentric against the wall of the inner chamber. As the rollers move along the tube, they force fluid through the tube. The displacement of fluid or the delivery rate of a peristaltic pump is determined by the flexible tubing diameter, the motor speed and any gears between the motor and the pump rollers.

In the prior art, peristaltic pumps have been in use since at least 1891. The Burson U.S. Pat. No. 460,944, issued in 1891 shows an example of a peristaltic pump of that period. A list of some of the prior art since 1891 showing the general principles of peristaltic pumps is as follows:

| | |
|---|---|
| Oliveras | U.S. Pat. No. 1,741,070 |
| Santiago et al | 1,988,337 |
| Knott | 2,314,281 |
| Wittenberg | 2,403,372 |
| Bogoslowsky | 2,414,355 |
| Vogel et al | 2,885,967 |
| Simer et al | 2,930,326 |
| Daniels | 2,955,543 |
| Seyler | 2,977,890 |
| Brkich | 3,067,692 |
| Worth et al | 3,358,609 |
| Muller | 3,384,080 |
| Jess | 4,155,362 |

The flexible tubing used in peristaltic pumps is important since it is the heart of the pump and has to sustain stresses from repeated flexing and abrasion due to the repeated contact with the rollers. Under repeated flexing and abrasion the flexible tubing will fail and fracture, causing leakage. A characteristically short tubing life is perhaps the most serious drawback to using peristaltic pumps more generally, and has severely limited the range of present applications. This problem has been recognized and explored in a number of prior art patents which attempt to prolong the tubing life by redesigning the tubing.

| | |
|---|---|
| Seyler | U.S. Pat. No. 2,693,766 |
| Mascaro | 2,917,002 |
| Mascaro | 2,925,045 |
| Murray | 2,987,004 |
| Vadot | 3,192,863 |
| Fitter | 3,875,970 |
| Gerritsen | 3,887,306 |
| LeGeay, nee Lechat et al | 4,080,113 |
| Gerritsen | 4,110,061 |

Peristaltic pumps have an economic advantage over other types of pumps and the added cost of specifically designed tubing would take away some of this advantage. Further, the tubing of the prior art will eventually fail and need to be replaced. The risk of failure, cost of down time and the replacement cost of the prior art specially designed tubing will detract from the economic advantage that peristaltic pumps have over other pumps.

Another approach in lengthening the life of the flexible tubing is to use a buffer material between the flexible tubing and the rollers. The Stanber U.S. Pat. No. 3,583,838 shows a flexible ring 17 in FIG. 2 that seals the roller bearing of the eccentric roller of the pump. The ring 17, however, does not actually act as a buffer but acts with the roller in contacting the tubing as described previously. The abrupt and highly localized longitudinal stresses resulting in the tubing's wall generally caused by direct roller contact are not avoided. The Shlisky U.S. Pat. No. 3,591,319 teaches a conduit protective member between a plurality of rollers and the flexible tubing. However, in order for the conduit protective member to act as a buffer, the flexible conduit is stretched over the rollers sufficiently for occlusion to take place and for the flexible conduit to lie against the protective member in such frictional engagement so as to prevent wandering and eliminate any longitudinal stretching and abrasion of the flexible conduit. As a result of tightly extending the flexible conduit over the rollers, other stresses are introduced that offset any gain obtained by the protective member. The Gelfand U.S. Pat. No. 3,723,030 shows a plurality of tubes, each protected from the rollers by a nylon strip. This protective strip offers minimal protection to the tubing since it merely eliminates the contact with the roller and does not reduce the severity of the stress caused by the rollers.

Further, all the protective strips in the prior art are susceptible to abrasive wear, creep, and eventual failure from the constant action of the rollers. The failure of the protective strips results in either direct contact between the rollers and the flexible conduit or in creating the situation where the protective strip now fractured from fatigue becomes a source of abrasion. There is a need for a better protective strip for extending the life of the flexible tubing.

In order to change the delivery rate of the peristaltic pumps of the prior art, the diameter of the flexible conduit was changed as taught in the Gelfand patent. Changing the flexible conduit requires stopping the pump and substituting a different size conduit to change the delivery rate. The delivery rate could also be changed by varying the rotor speed, as is also taught in the Gelfand patent. The Berman et al U.S. Pat. No. 3,737,251 and Vial U.S. Pat. No. 3,990,444 show stepping motors being used to vary the rotor shaft speed. Stepping motors and other variable speed motors are expensive and eliminate the economic advantage that peristaltic pumps have over other pumps. Pumps such as piston pumps can easily change their delivery rate by merely varying the stroke of the piston. There is a need for a peristaltic pump having the capability of a variable delivery rate without the use of an expensive variable speed motor or the need of shutting down the pump and changing the flexible tubing.

SUMMARY OF THE INVENTION

The present invention is a variable volume peristaltic pump which can be driven by a single speed power source. The peristaltic pump has a housing with an arcuate chamber and a fixed length of flexible wall tubing arranged circumferentially in the arcuate chamber. An adjustable band is circumferentially arranged along the flexible conduit holding the conduit against the chamber wall. A plurality of rollers are rotatably attached to a rotor coaxially positioned within the arcuate chamber. The rollers engage the adjustable band and compress the flexible tubing against the wall of the arcuate chamber forcing fluid to flow through the flexible tubing.

The adjustable band is secured to the housing at one end and is attached at the other end to adjusting means for varying the effective length of the adjustable band. When the effective length of the adjustable band is increased, the flexible tubing is flattened against the arcuate chamber wall, thereby changing the cross-sectional area of the tubing and consequently the volume. With the volume changed, the capacity of the flexible tubing has correspondingly been changed and the delivery rate of the pump altered. Retracting the adjustable band produces the opposite effect, allowing the tubing to increase its cross-sectional area thereby increasing the delivery rate of the pump.

DETAILED DESCRIPTION OF THE PREFERRED EMBODIMENTS

Figure 1:
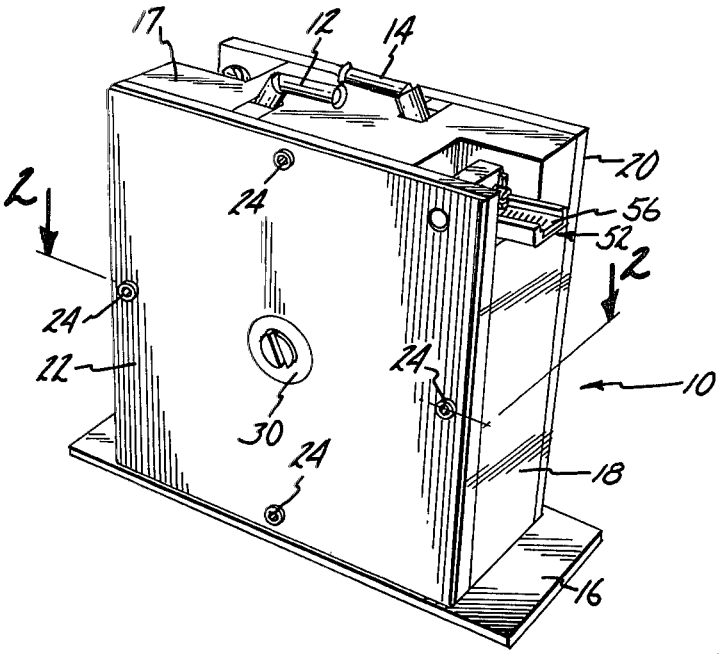
FIG. 1 is a perspective view of the peristaltic pump of the present invention.

FIG. 1 generally shows a peristaltic pump of the present invention with a housing generally indicated at 10. The pump housing 10 has an inlet 12 and an outlet 14. The pump housing 10 further has a base 16 and a center casing 18 with side wall panels 20 and 22 fixedly attached to each side of the center casing 18 by screw threaded fasteners 24.

Figure 2:
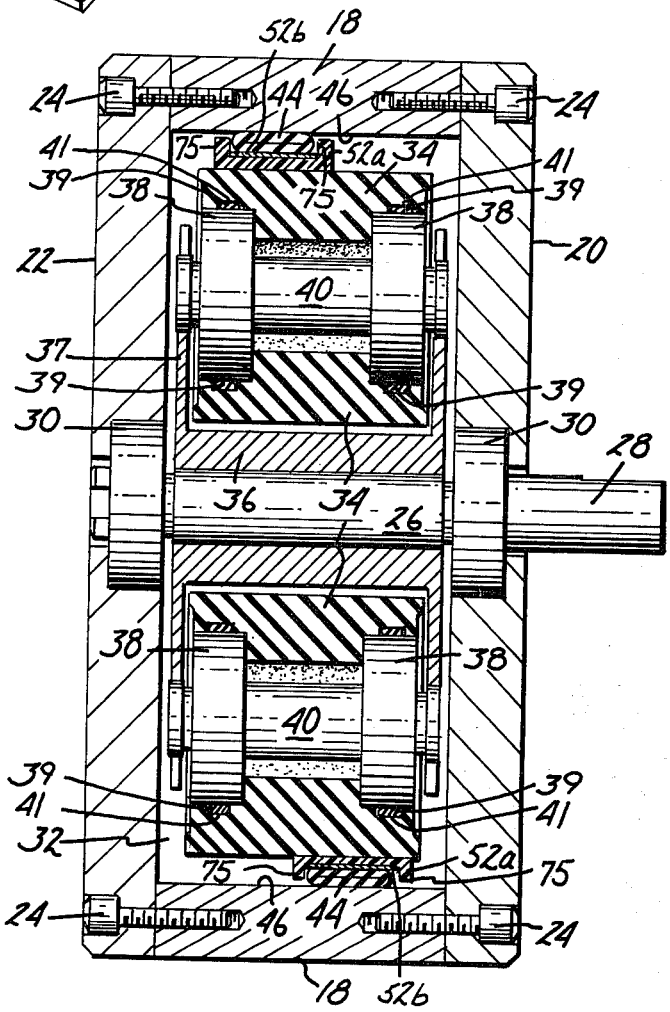
FIG. 2 is a cross-sectional view taken, with the same portions shown in full for clarity, along the plane 2—2 in FIG. 1.
Figure 3:
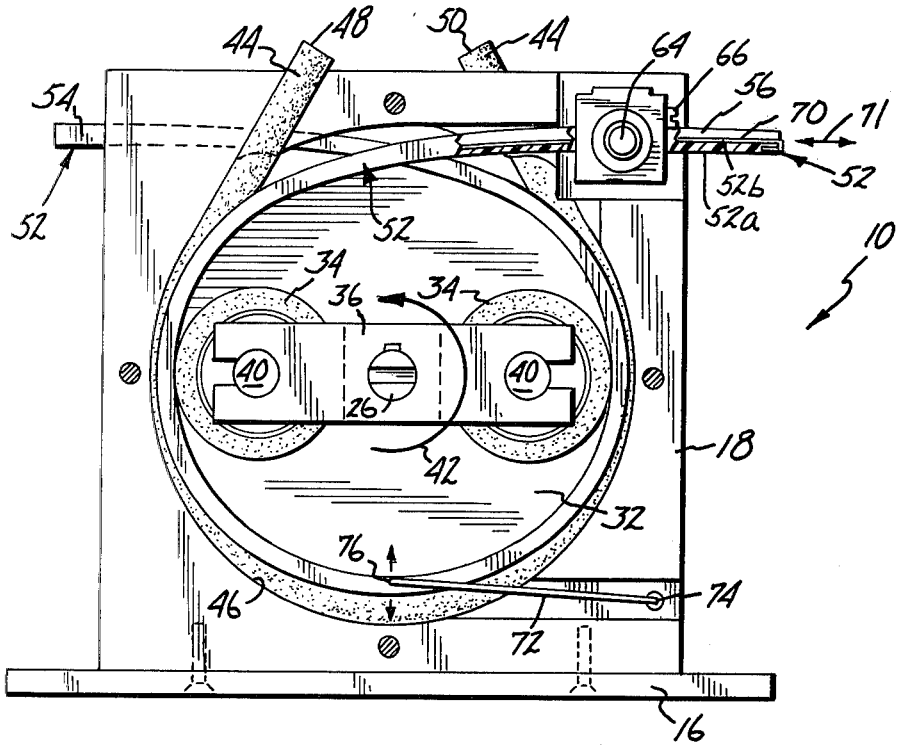
FIG. 3 is a front view with certain portions removed for better viewing of the working elements.

In FIGS. 2 and 3 a drive shaft 26 is shown rotatably attached to side walls 20 and 22 and attached at end 28 to a motor (not shown). The drive shaft 26 is mounted within a set of bearings 30 which are preferably mounted within side walls 20,22. The casing 18 and side walls 20,22 form an arcuate chamber 32, and the rotor 36 is situated coaxially within arcuate chamber 32.

The rotor 36 is mounted on the drive shaft 26 and the rollers 34 are rotatably mounted by bearings 38 on shafts 40 which are fixedly attached at opposite ends of the rotor 36. Each roller 34 is rotatably attached between rotor arms 37. An O-ring 39 is situated within relief 41 and acts as a mechanical spring, absorbing variations in manufacturing tolerances within the arcuate chamber 32.

A flexible conduit 44 having a fixed length is circumferentially spaced along the arcuate chamber wall 46. The flexible conduit 44 has an inlet opening 48 and an outlet opening 50 corresponding to the pump inlet 12 and outlet 14, respectively. The flexible conduit 44 transports the fluid being pumped through its interior.

Figure 4:
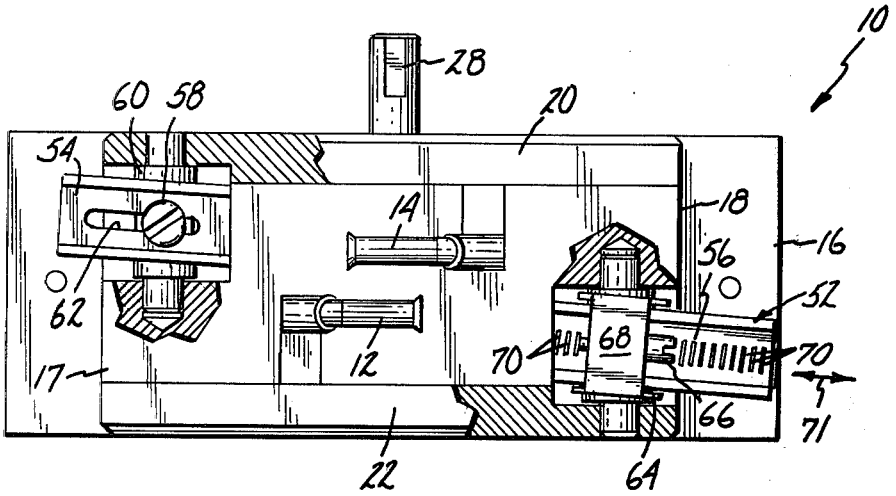
FIG. 4 is a fragmentary top view showing the attachment of the flexible band.

An adjustable band 52 is circumferentially positioned between the rollers 34 and the flexible conduit 44. The adjustable band 52 holds the flexible conduit 44 against the chamber wall 46. The adjustable band 52 is pivotally attached to the pump housing 10 at one end 54 and is adjustably (and pivotally) attached to the pump housing 10 at the other end 56 as best seen in FIGS. 3 and 4. The end 54 is attached by a screw threaded fastener 58 to a trunnion 60 which is in turn mounted in the pump housing 10. The screw threaded fastener 58 holds end 54 by engaging slot 62 and allows the end 54 to oscillate longitudinally within the slot 62 without any transverse movement resulting in minimization of the load on the trunnion 60 when the pump is in operation.

The adjustable end 56 engages preferably a screw type adjusting clamp 64 which includes an adjusting screw 66 and a body 68 having tabs (not shown) for keeping the adjusting screw 66 within the body 68. The clamp 64 is pivotally attached to the pump housing 10 and has a slot through which the adjustable end of the adjustable band 52 is received. A longitudinal section of the threads of adjusting screw 66 is received within the slot and engages grooves 70 of the adjustable end 56. When the adjusting screw 66 is turned, the threads of the screw engage the grooves 70 and move the adjusting end 56 through the slot of the clamp 64, the direction depending on which way the adjusting screw 66 is turned, as indicated by an arrow 71. The screw type clamp 64 has a similar mechanical movement to a conventional hose clamp used to secure rubber hoses in an automobile. It should be understood that any conventional means that securely holds the adjusting end 56 and has the capability of allowing infinitely variable adjustments during pump operation may be used without departing from the scope of the present invention.

The adjustable band 52 is comprised of a stiffening band **52*a* and a strengthening band 52*b*. The stiffening band 52*a* is made of a polymer having sufficient fatigue resistance and a sufficient amount of flexibility, preferably polypropylene. A creep resistant strengthening band 53*b* is fixedly attached to the stiffening band 52*a* on the side engaging the flexible conduit 44 as shown in FIGS. 2 and 3. The strengthening band 52*a* is preferably made of beryllium copper alloys, beryllium nickel alloys or 400 series stainless steel alloys. However, any material having adequate fatigue resistance will suffice. Materials commonly used for coiled and flat springs are most applicable because they have a high endurance limit when compared to other materials. But resiliency is not required of metal band 52*b*. Its purpose is to prevent stretching ("creep" due to tensile forces) of the plastic band 52*a* and provide strong attachments with the worm screw 66 and the pivoting arm at second pivot point 76**. "Creep" is defined as permanent deformation due to an inability of a stressed member to completely recover its original shape. For example, if plastic is stressed for a prolonged period, molecular bonds will dislocate within the microstructure of the material, causing permanent deformation. Creep in metals is negligible at normal levels of stress. Creep in plastics is a common problem and occurs at very low stress levels.

The basic purpose of the composite band 52 formed by plastic band **52*a* and metal band 52*b* is to maintain an essentially circular spiral during pump operation. It must have a stiffness that provides a gradual curvature within the circumstance of the chamber, thus avoiding excessive contact forces and highly localized tubing stresses. For a given pump geometry and a given tubing diameter, the band length and required deflection is defined; and tubing stiffness determines the minimal band rigidity that is desirable. Given a fixed length and a required deflection, the band stiffness is essentially a function of only two variables—the elastic modulus (a material property) and the section modulus (a geometric property of the cross section). Band stiffness is proportional to the product of these elements. A metal band could be constructed with the proper stiffness. However, for practical limitations of pump geometry and tubing products, the induced bending stresses exceed the endurance limit of all practical metal alternatives. Hence, the preferred embodiment of the present invention uses a composite, laminated band construction formed by bands 52***a* and 52*b*.

The relatively thick plastic band 52*a* provides a large section modulus. The low elastic modulus common to plastic materials minimizes internal stresses during flexure and polypropylene is particularly advantageous because of its exceptional fatigue strength. The polypropylene band 52*a* provides the necessary flexural characteristics of stiffness and fatigue life but lacks the necessary tensile requirements of strength and creep resistance. The metal band 52*b* provides those needs. The stiffness of the plastic band 52*a* keeps the radius of curvature of the composite band large during flexure. Because the radius of flexure is large and the thickness of the metal band 52*b* is small, internal stresses in the metal component are effectively kept below the material endurance limit. At the same time, sufficient tensile strength is available for the attachments at points 56 and 76. The plastic and metal bands 52*a* and 52*b* reinforce each other while together fulfilling the mechanical demands of pump operation.

As shown in FIG. 2 the flexible conduit 44 is situated between the arcuate chamber wall 46 and the strengthening band 52*b*, being held in place by retaining members 75. The spacing between the retaining members 75 is sufficient to accept several tubing sizes. The retaining members 75 and the thickness of the plastic band 52*a* provide a gradual curvature of the adjustable band 52 within the arcuate chamber thereby avoiding any high localized stress to the flexible conduit.

A pivoting arm 72 is pivotally attached to the pump housing 18 at first pivot point 74 at one end and to the adjustable band 52 at second pivot point 76 at the other end. The second pivot point 76 is located directly below the center of the drive shaft 26, and first pivot point 74 is located on the side of the pump housing 10 which is toward the direction of rotation 42 of the rotor 36 as shown in FIG. 3. The pivoting arm 72 keeps the flexible band 52 substantially centered within the arcuate chamber 32.

Several advantages and effects are realized in the combination of the pivoting arm 72 and the manner that the screw threaded fastener 58 holds end 54 to the trunnion 60. First, any net tensile or compressive forces are avoided in the discharge half of the adjustable band 52, defined from the second pivot point 76 to end 54. Secondly, the suction half of the adjustable band, defined from adjustable end 56 to second pivot point 76, is always in a net positive tensile posture, ensuring that buckling of the adjustable band will not occur. The net positive tensile force in the adjustment band will also cause the band to be forced away from the flexible conduit. Thirdly, any net tensile force in the pivoting arm 72 will always be positive, avoiding any buckling of the pivot arm. Fourthly, the pivoting arm 72 effectively contains the adjustment of the adjustable band to the suction side of the pump between the adjusting clamp 64 and the second pivot point 76. The function of the discharge portion of the adjustable band is only to provide a continuous roller contact, thereby maintaining a positive seal for an entire revolution of the rollers 34. Lastly, any variations in manufacturing tolerances are easily absorbed by the pivoting arm 72 and the manner of attachment of the end 54 to the trunnion 60.

The adjustable band 52 serves several purposes. The adjustable band 52 protects flexible conduit 44 from the direct contact of the rollers 34 thus avoiding abrasion, and the abrupt and highly localized tensile and shear stresses otherwise caused by direct contact with the rollers and extending the life of the flexible conduit 44. The retaining members 75 of the flexible conduit 44 aid in extending the life of flexible conduit 44 by retaining the flexible conduit 44 within the protection of the adjustable band 52. In addition, retaining members 75 prevent any twisting of the flexible conduit 44 which would otherwise occur if the flexible conduit 44 was allowed movement in the axial direction. The preferred combination of the metal band 52*b* and the polypropylene band 52*a* add to the life of the adjustable band 52 while also providing a sufficient buffer for protecting the flexible conduit 44 from undue flexing and abrasion caused by the continuous action of the rollers 34.

The inherent spring-back characteristic of round resilient tubing is relied upon in prior art peristaltic pumps to draw fluid into the pump and to provide a consistent volumetric displacement. The stronger the spring-back, the higher the suction draw and also the more consistent the delivery rate. However, the induced stresses that provide spring-back in round tubing are essentially the same ones causing tubing failure. The present invention accommodates the same resilient tubing used in prior art peristaltic pumps, but does not have to rely on inherent spring-back characteristics to the same extent. The adjustable band 52 and the casing bore combine to provide effective control of tubing recovery, and reduce the need for round tubing.

A round conduit is not necessary fo consistent delivery and therefore high stress levels can be avoided. In such cases, fluid can be induced into the pump either mechanically (e.g. physical attachment of the conduit to its radial boundaries), or hydraulically (e.g. a positive suction pressure). The detrimental levels of tubing stress that accompany the utilization of spring-back in prior art peristaltic pumps can be avoided with the present invention.

Figure 5:
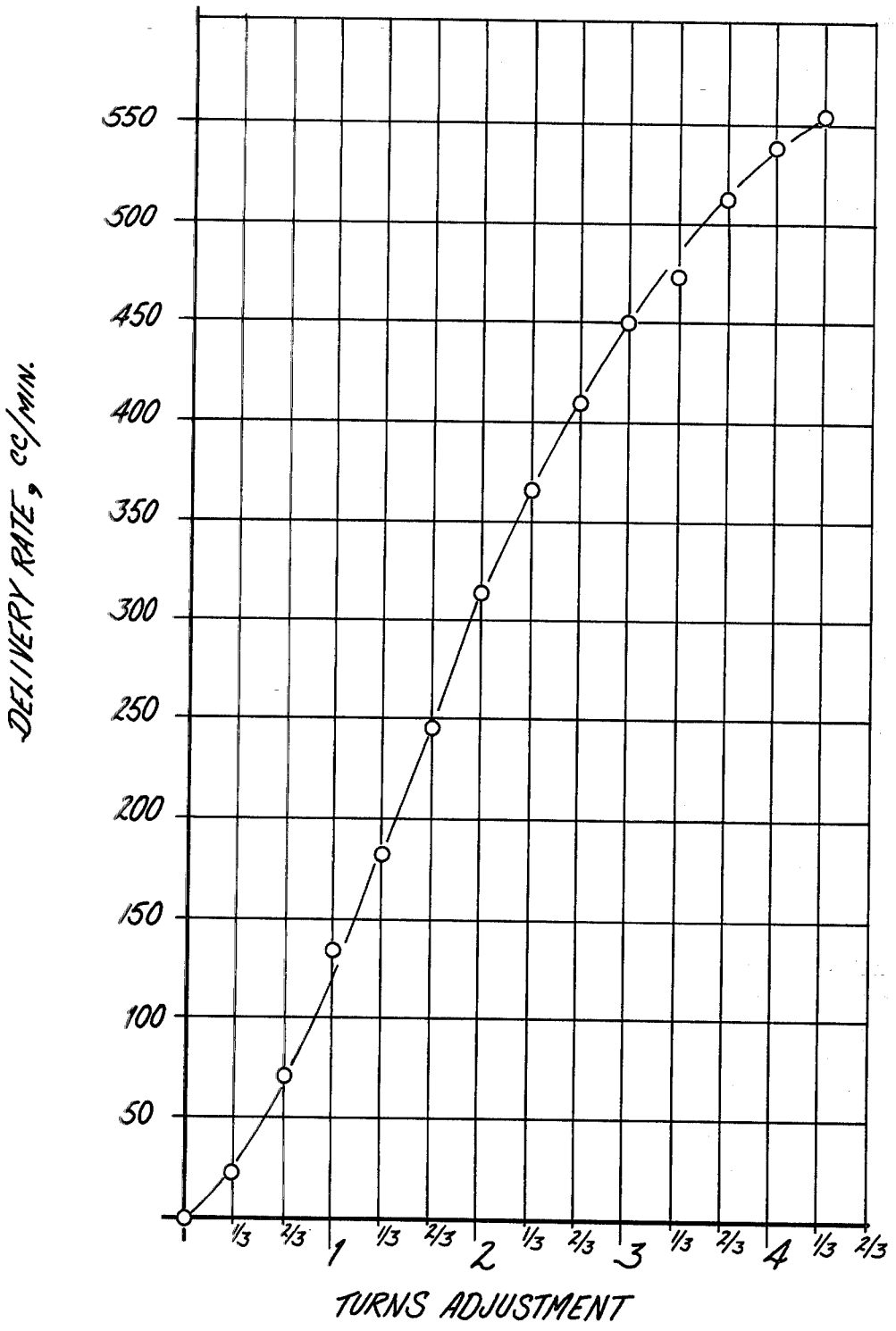
FIG. 5 is a calibration curve of variable flow rate capability of one embodiment of the peristaltic pump of the present invention.

The adjustability of the adjustable band 52 provides the present invention with the capability of a variable delivery rate without replacing conduit 44 and without the need of an expensive speed motor. With the present invention, the delivery rate can be changed while the peristaltic pump is operating. FIG. 5 shows a calibration curve of one model of the peristaltic pump of the present invention that has a round flexible conduit with a one-quarter inch inner diameter and an arcuate chamber having a five inch bore diameter. The peristaltic pump was operated at 89.3 revolutions per minute. The horizontal axis entitled "Turns Adjustment" refers to the number of turns that the adjusting screw 66 was turned from a zero point. The vertical axis entitled "Delivery rate, cubic centimeters per minute" refers to the output of the particular model of the peristaltic pump of the present invention. At the zero point, the delivery rate is zero and the adjusting screw is at a point where the flexible conduit is completely flattened against the chamber wall by the adjustable band, the adjustable band being at the longest length possible within the arcuate chamber. Turning the adjusting screw shortens the flexible band 52, removing pressure from the flexible conduit 44 and increasing the volumetric capacity of conduit 44. This results in an increased delivery rate of the peristaltic pump as shown by the data points in the calibration curve connected by lines.

The capability of varying the delivery rate while the peristaltic pump is operating eliminates the need for a costly variable speed motor. Further economies can be achieved by driving several pumps with the same constant speed motor, each pump having the capability of being adjusted independently during operation. Also, several pumps can be driven by the same single speed motor, each pump having a flexible conduit with a different inner diameter providing a wide array of delivery rates, all delivery rates being adjustable during operation.

Although the present invention has been described with reference to preferred embodiments, workers skilled in the art will recognize that changes may be made in form and detail without departing from the spirit and scope of the invention.

What is claimed is:

1. A peristaltic pump comprising:

housing means with an arcuate chamber defined by an arcuate wall;

rotor means coaxially positioned within the arcuate chamber;

a plurality of roller means spaced circumferentially within the arcuate chamber and rotatably attached to the rotor means;

flexible conduit means circumferentially arranged within the arcuate chamber;

adjustable band means circumferentially arranged in the arcuate chamber between the flexible conduit means and the roller means for longitudinally engaging the flexible conduit means; and, adjusting means for adjusting the effective length of the flexible band means to adjust the extent of flattening of the flexible conduit means against the arcuate chamber wall and thereby adjusting the volumetric capacity thereof.

2. The peristaltic pump of claim 1 wherein the roller means comprises two rollers rotatably attached to the rotor means.

3. The peristaltic pump of claim 1 including a single speed power source.

4. The peristaltic pump of claim 1 wherein the flexible band means is a fatigue-resistant synthetic polymer band.

5. The peristaltic pump of claim 4 wherein the synthetic polymer band is polypropylene.

6. The peristaltic pump of claim 4 wherein the flexible band further includes a fatigue-resistant metal band fixedly attached to the synthetic polymer band on the side engaging the flexible conduit.

7. The peristaltic pump of claim 6 wherein the fatigue-resistant metal band is a metal of the group consisting of beryllium nickel alloys, beryllium copper alloys, and series 400 stainless steel alloys.

8. The peristaltic pump of claim 1 wherein the adjustable band means completes a full spiral within the arcuate chamber of the housing means.

9. The peristaltic pump of claim 1 further comprising:

pivot arm means for holding the adjustable band means in an arcuate shape within the arcuate chamber of the housing means.

10. The peristaltic pump of claim 9 wherein the pivot arm means is pivotally connected to the housing at a first pivot point and is pivotally connected to the adjustable band means at a second pivot point.

11. The peristaltic pump of claim 1 wherein the adjustable band includes retaining members longitudinally positioned on opposing sides of the flexible conduit retaining the flexible conduit in an engaging position with the adjustable band.

12. The peristaltic pump of claim 1 wherein the adjustable band means is connected to the housing proximate a first end and is connected to the adjusting means proximate a second end.

13. The peristaltic pump of claim 12 wherein the adjusting means is connected to the housing and includes means for clamping the adjustable band means proximate the second end of the adjustable band means.

14. The peristaltic pump of claim 13 wherein the flexible conduit means has an inlet and an outlet.

15. The peristaltic pump of claim 14 and further comprising pivot arm means pivotally connected to the housing at a first pivot point and pivotally connected to the adjustable band means at a second pivot point, and wherein the adjusting means adjusts the effective length of the adjustable band means between the adjusting means and the second pivot point.

16. The peristaltic pump of claim 15 wherein adjusting the effective length of the adjustable band means between the adjusting means and the second pivot point adjusts the extent of flattening of the flexible conduit means in a portion between the inlet and the second pivot point.

* * * * *